US007291120B2

(12) United States Patent
Kyoji et al.

(10) Patent No.: US 7,291,120 B2
(45) Date of Patent: Nov. 6, 2007

(54) MASSAGE DEVICE

(76) Inventors: Ikeda Kyoji, LSP504 2-20-12 Ryogoku, Sumida-ku, Tokyo (JP) 130-0026; Ching-Feng Chuang, 8F.-2, No. 32, Guihe St., Taichung City (TW)

( * ) Notice: Subject to any disclaimer, the term of this patent is extended or adjusted under 35 U.S.C. 154(b) by 91 days.

(21) Appl. No.: 11/390,062

(22) Filed: Mar. 28, 2006

(65) Prior Publication Data

US 2007/0232970 A1 Oct. 4, 2007

(51) Int. Cl.
*A61H 15/00* (2006.01)

(52) U.S. Cl. ..... 601/118; 601/121

(58) Field of Classification Search ..... 601/118, 601/121, 128–131, 134, 135
See application file for complete search history.

(56) References Cited

U.S. PATENT DOCUMENTS 1,947,042 A * 2/1934 Glennan ..... 401/174
5,127,395 A * 7/1992 Bontemps ..... 601/19
6,245,031 B1 * 6/2001 Pearson ..... 601/118
6,931,689 B2 * 8/2005 Huang ..... 15/209.1
2005/0044647 A1 * 3/2005 Hohlbein ..... 15/167.1

FOREIGN PATENT DOCUMENTS

JP 7-9344 U 2/1995

* cited by examiner

*Primary Examiner*—Michael A. Brown
(74) *Attorney, Agent, or Firm*—Birch, Stewart, Kolasch & Birch, LLP

(57) ABSTRACT

A massage device to hold a golf ball has a surrounding portion to cover the golf ball and a handgrip extended from the surrounding portion. The handgrip has an insertion orifice on the bottom to receive a tee. The periphery of the handgrip that joins the surrounding portion has grasping ditches to be grasped by user's fingers. The outer surface of the massage device has a plurality of conical jutting elements. The device can hold a golf ball and a tee, and also can be held securely by user's hand to do massage on various portions of user's body.

11 Claims, 6 Drawing Sheets

MASSAGE DEVICE

FIELD OF THE INVENTION

The present invention relates to a massage device and particularly to a massage device that can cover a golf ball and hold a tee and has jutting elements on the surface to be used for massaging of user's body.

BACKGROUND OF THE INVENTION

The conventional golf ball has a plurality of dimples on the surface and is quite hard, hence some users frequently grasp and turn it in the palm to do massage on body muscle, or rub or compress the neck, shoulder, arms and soles. However the golf ball is too hard and not elastic. Rubbing continuously on people's skins and muscle tends to inflict pain. Moreover, the golf ball is rather small and difficult to be held and turned or pushed in the palm to do massage actions on various portion of people's body. It also easily drops while held in the palm. Hence its massage effect is not desirable especially compared with other massage tools that have jutting elements to compress and roll over people's body.

Japan patent No. 7-9344 discloses a device made of a hard material that can hold a golf ball and has a body formed like a strut. The body has a cavity in the center of the bottom to hold the golf ball on the upper half portion. The cavity has a peripheral rim to brace the upper half portion of the golf ball. The body has a plurality of jutting elements on the lower periphery to hold the lower half portion of the golf ball. The golf ball can move freely in the cavity along a straight line, a curve or circular to roll or compress various portions of user's body to do massage function. However, it performs massage on people's muscle through the golf ball that is made from a hard material. Hence it still inflicts pain on people's body.

SUMMARY OF THE INVENTION

In view of the aforesaid disadvantages, the present invention aims to provide a massage device that can surround a golf ball and also hold the golf ball and a tee. It has grasping ditches on the profile that can be grasped easily by user's fingers. The outer surface also has a plurality of conical jutting elements to facilitate secured holding and massaging on user's body.

The primary object of the invention is to provide a massage device to cover a golf ball. It has a surrounding portion to cover the golf ball and a handgrip extended from the surrounding portion to be grasped by user's hand. The handgrip has an insertion orifice on the bottom to receive a tee. The periphery of the handgrip that joins the surrounding portion has indented grasping ditches to be grasped by user's fingers. The surface of the massage device has a plurality of conical jutting elements to be held securely by user's hand to perform massage functions by patting, turning or compressing various portions of user's body.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
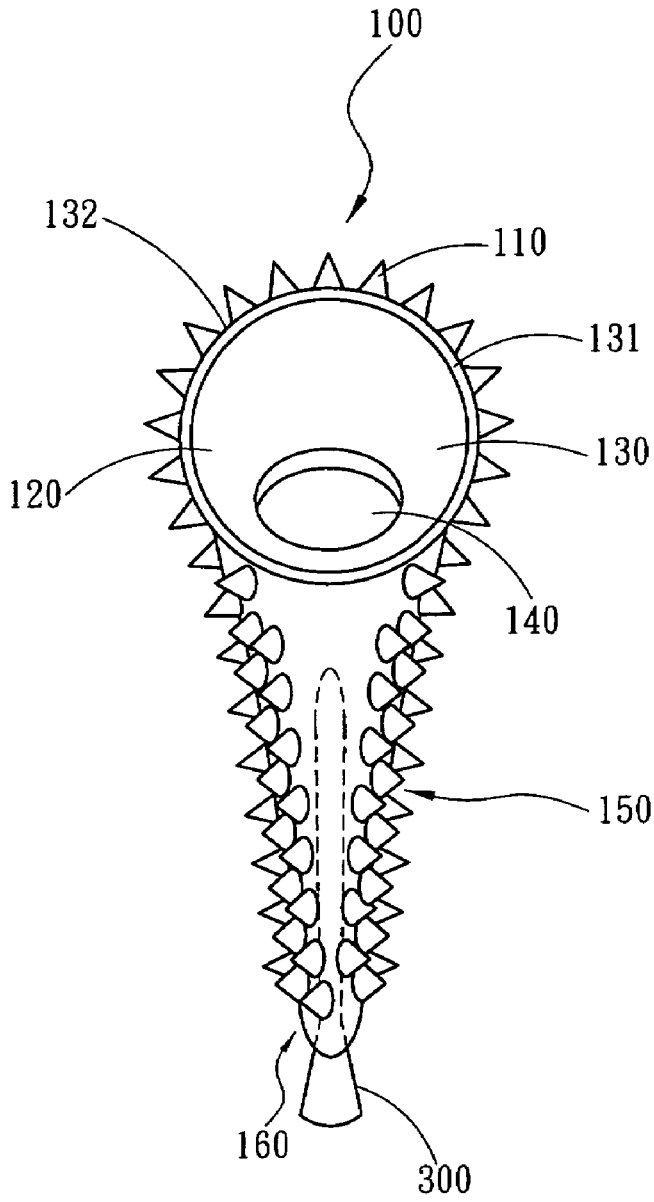
FIG. 1 is a front view of an embodiment of the invention.
Figure 2:
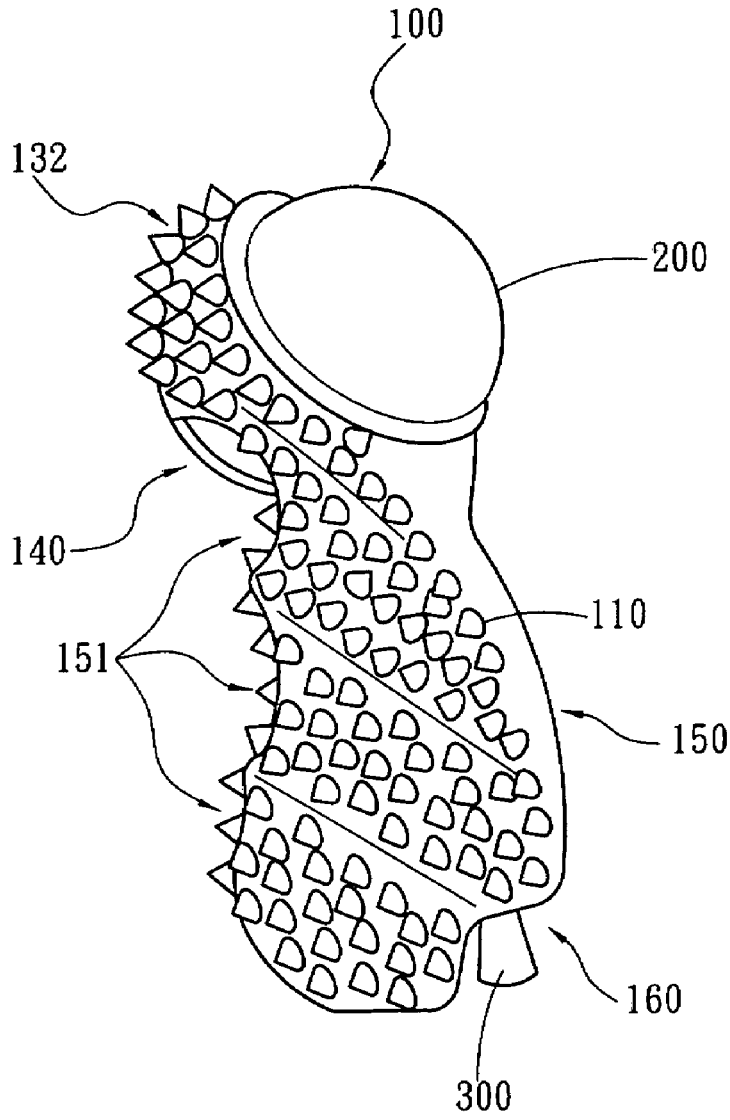
FIG. 2 is a perspective view of an embodiment of the invention.

Please refer to FIGS. 1 and 2, the massage device 100 of the invention includes an annular hollow portion 120 on one end which has a surrounding portion 132 to cover a ball 200 (such as a golf ball). The surrounding portion 132 is made from plastics and is elastic, and has a cavity 140 on a front side and a circular opening 130 on the periphery of the cavity 140 formed at a size greater than the cavity 140. The opening 130 has a rim 131 on the periphery. The ball 200 can be inserted in the hollow portion 120 surrounded by the surrounding portion 132. The rim 131 has a diameter smaller than that of the ball 200 to confine the ball 200 from dropping out. The massage device also has a handgrip 150 extended from the surrounding portion 132. The handgrip 150 has three grasping ditches 151 corresponding to the index finger, middle finger and third finger of a user's hand to be grasped by hands easily to move the massage device 100. The handgrip 150 has an insertion orifice 160 on the bottom to receive a tee 300. The outer surface of the surrounding portion 132 and handgrip 150 has a plurality of conical jutting elements 110 to provide massage function when held by the hand.

Figure 3:
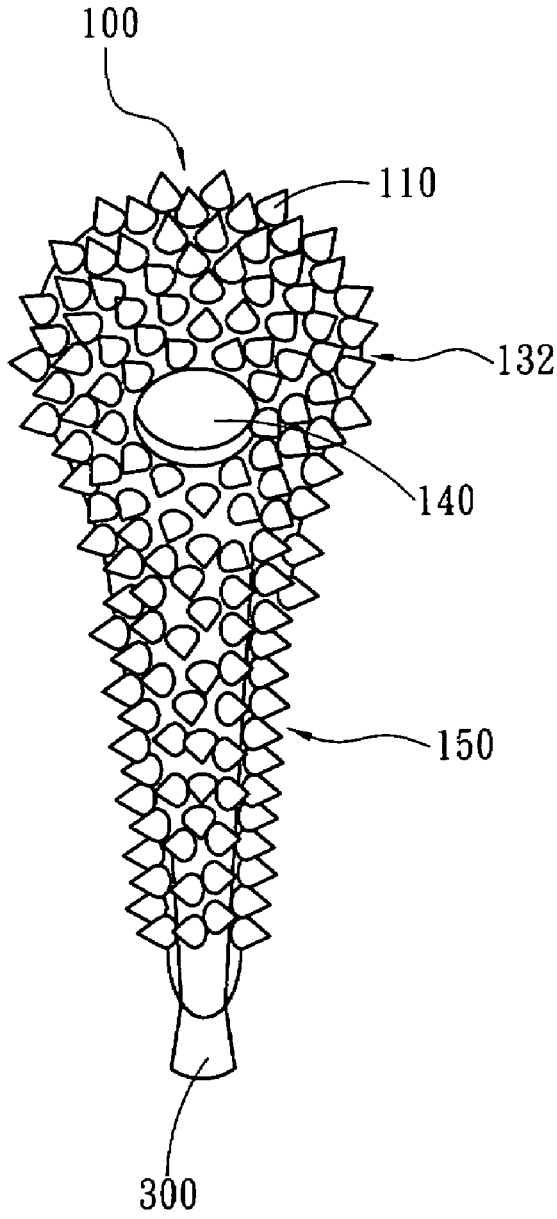
FIG. 3 is a rear view of an embodiment of the invention.

Refer to FIG. 3, the conical jutting elements 110 are formed on the surface of the massage device 100. The cavity 140 of the surrounding portion 132 enables a finger to run through to push the ball 200 outwards. The opening 130 aims to aid the ball 200 to slip out.

Figure 4:
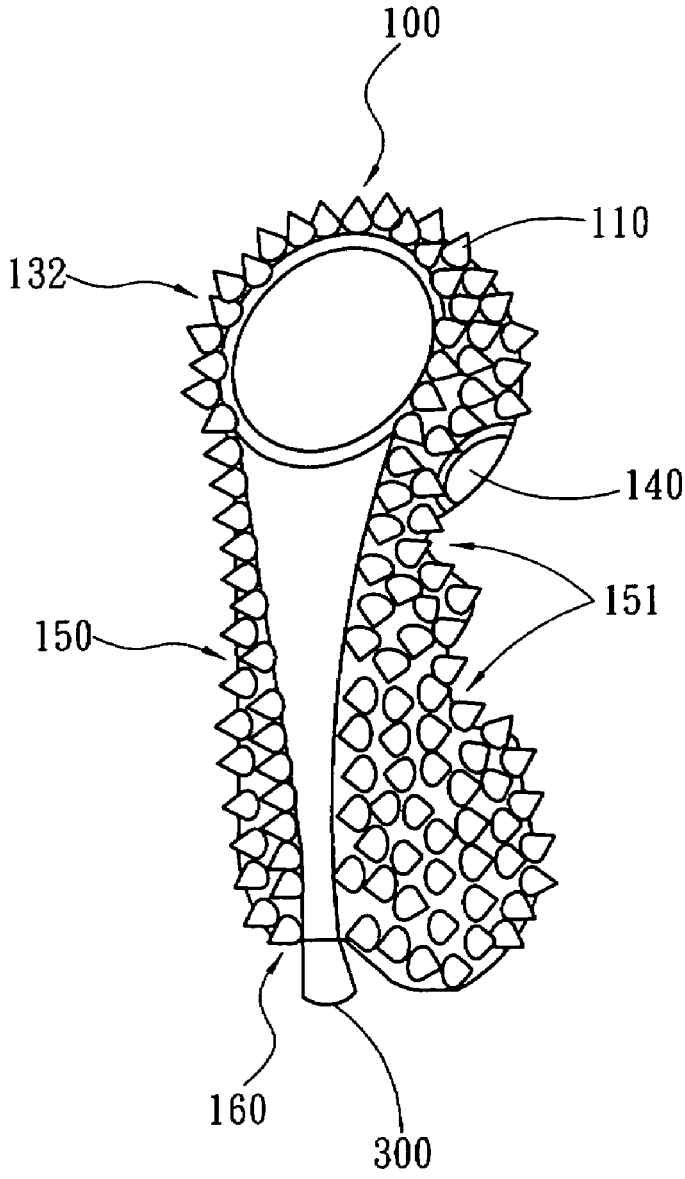
FIG. 4 is another perspective view of an embodiment of the invention.

Refer to FIG. 4 for a further view of the conical jutting elements 132 on the surface of the surrounding portion 132 and the handgrip 150, and the cavity 140 of the surrounding portion 132 for pushing the ball 200 outwards. The indented grasping ditches 151 to be held by the index finger, middle finger and third finger also are shown. The insertion orifice 160 on the bottom of the handgrip 150 to receive the tee 300 also is depicted.

Figure 5:
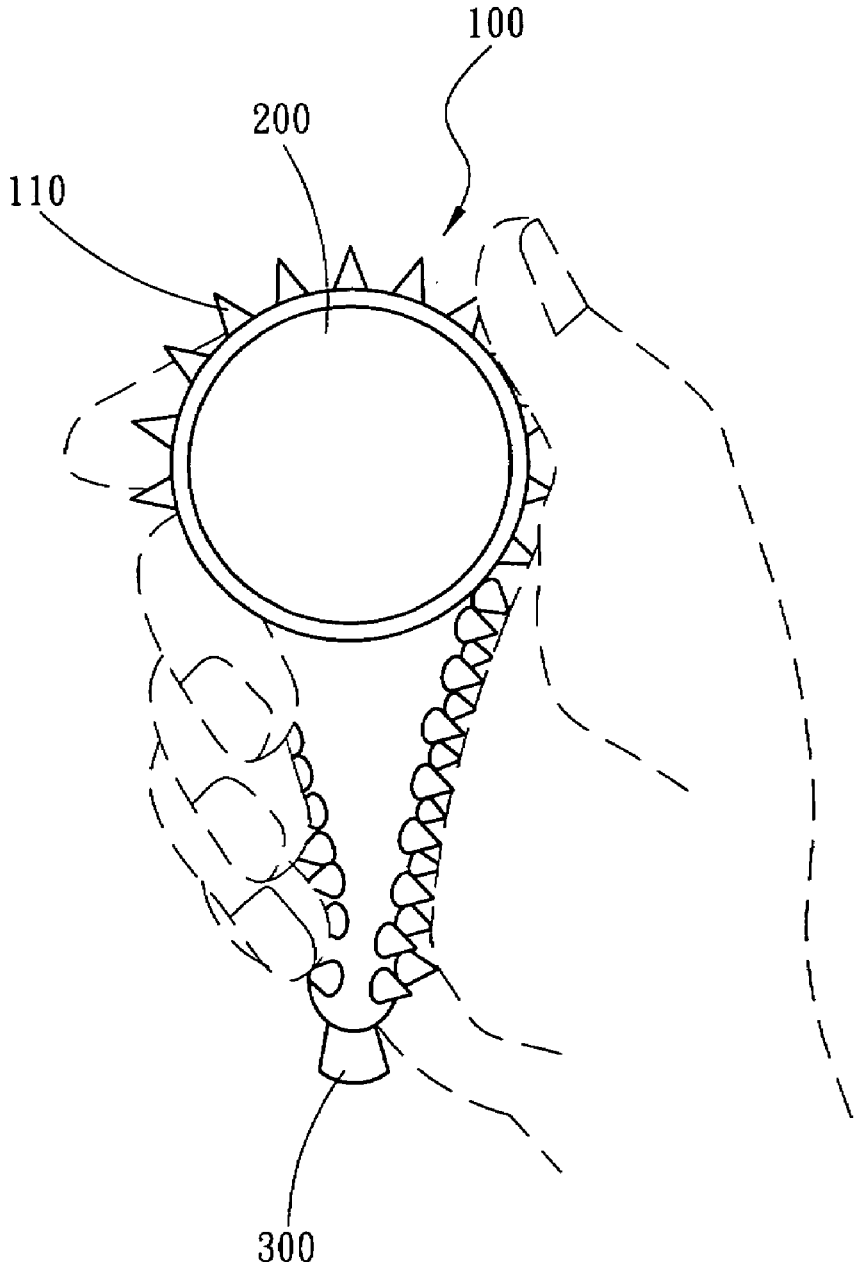
FIG. 5 is a schematic view of an embodiment of the invention held by a right hand.

Refer to FIG. 5 for the invention grasped by a user's right palm. User can pat and massage the shoulder, arms, neck or soles with the ball 200. The grasping ditches 151 on the handgrip 150 can prevent the fingers from slipping during massaging. The massage device 100 can be held by the left hand after a slight alteration of the shape. With the massage device 100 and the ball 200 held by the hand, the jutting elements 110 can be used to do massage on user's shoulder, arms, neck and soles.

Figure 6:
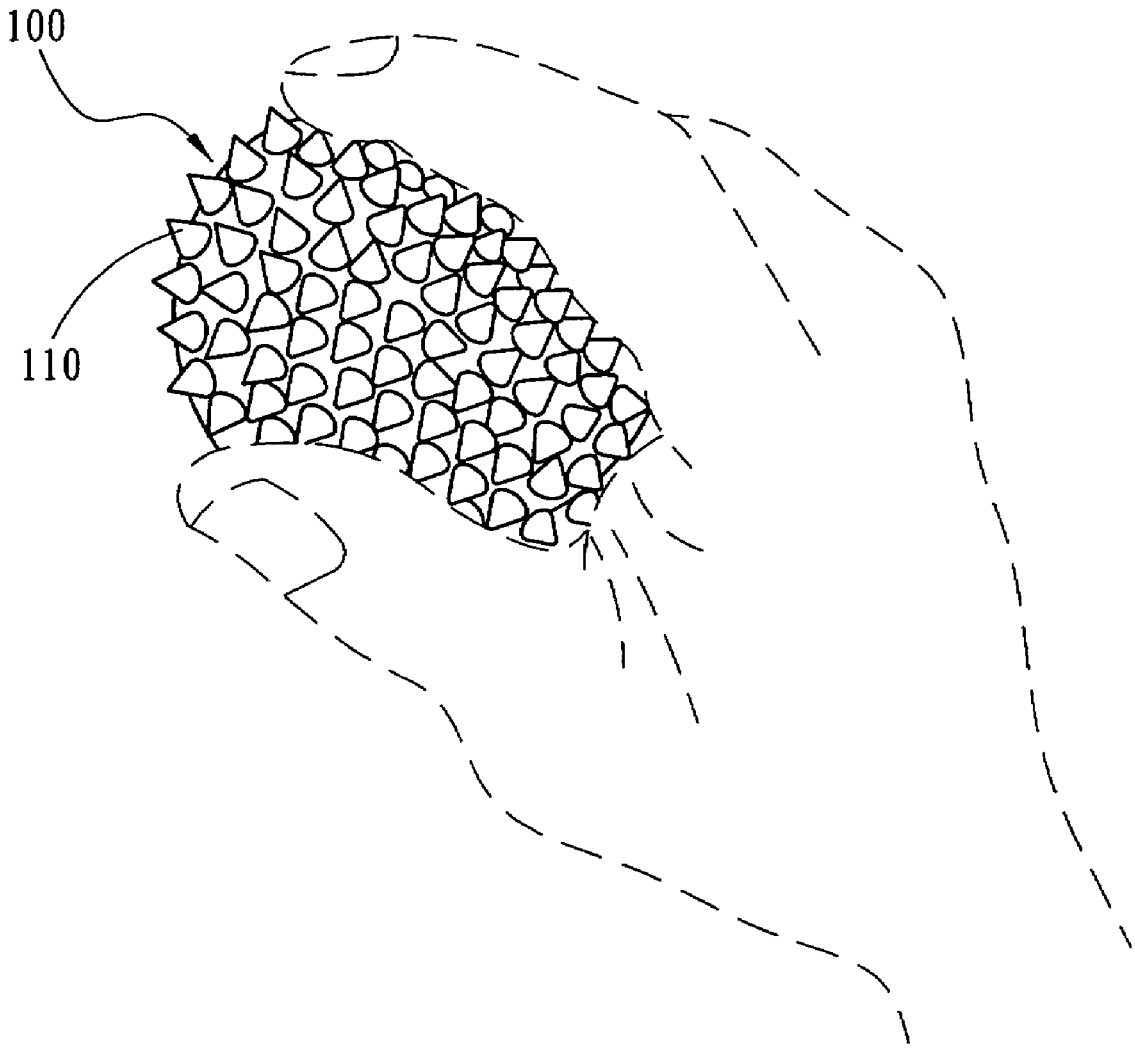
FIG. 6 is a schematic view from a back side of an embodiment of the invention held by a user's hand in a parallel manner.

Refer to FIG. 6 for a top view of the invention. With the massage device 100 held by a hand, the jutting elements 110 can massage and stimulate the thumb.

The massage device 100 of the invention, aside from made from plastics, can also be made from elastic resin or other hard material such as wood. However, to make the ball 200 to be inserted through the opening 130 and confined by the rim 131 without dropping out, the rim 131 has to be made from an elastic material and has a diameter smaller than that of the ball 200.

It is to be noted that the jutting elements 110 on the surface of the massage device 100 can be formed at the same size or different sizes. The conical angle of the jutting elements 110 may be altered according to requirements. The size and shape of the jutting elements 110 are arranged on the surface of the massage device 100 according to requirements, and are not limited to the shape of circular cones. They also may be formed in semi-circular cones, triangular cones or quadrangular cones or the like.

The massage device 100 can hold the ball 200 and a tee 300 at the same time. As the massage device 100 is designed based on a general gold ball 200, it is small and can be held in a pocket of an upper outer garment or a pant. Hence it is easy to carry.

In short, the invention can hold the ball 200 in the hollow portion 120 of the surrounding portion 132 to perform massage on user's fingers, palms, shoulder, neck, arms or soles to help relaxing. The jutting elements 110 on the surface of the massage device 100 can stimulate the fingers, palms, shoulder, neck, arms and soles. The shoulder, neck, arms and soles also may be patted through the massage device 100.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A massage device comprising a surrounding portion on one end that has an opening to receive and hold a ball and a handgrip extended from the surrounding portion that has a plurality of grasping ditches to be grasped by a hand, the surrounding portion and the handgrip further having a plurality of jutting elements on the outer surface thereof, the surrounding portion further having a cavity to allow the ball to be pushed out of the opening of the surrounding portion, and the handgrip having an insertion orifice on the bottom to receive a tee.

2. The massage device of claim 1, wherein the opening has a rim which is extendable and formed at a size smaller than the diameter of the ball, the surrounding portion having an inner wall to form a hollow portion to hold the ball without dropping out.

3. The massage device of claim 1, wherein the jutting elements are formed randomly at a diameter and a height.

4. The massage device of claim 3, wherein the jutting elements are distributed randomly.

5. The massage device of claim 1, wherein the jutting elements are formed with a same diameter and a same height.

6. The massage device of claim 5, wherein the jutting elements are distributed randomly.

7. The massage device of claim 1, wherein the surrounding portion is an elastic material which conforms to a shape of the ball, a majority of the surface of the ball being in contact with the surrounding portion.

8. The massage device of claim 1, wherein the opening to receive the ball has a circumference less than a circumference of the ball and wherein the cavity has a circumference less than the circumference of the opening, the cavity being on an opposite side of the surrounding portion from the opening, portions of the ball extending from both the opening and the cavity when the ball is received in the surrounding portion.

9. The massage device of claim 1, wherein the jutting elements are distributed through the outer surface of the surrounding portion and the handgrip.

10. The massage device of claim 9, wherein the opening to receive the ball has a circumference less than a circumference of the ball and wherein the cavity has a circumference less than the circumference of the opening, the cavity being on an opposite side of the surrounding portion from the opening, portions of the ball extending from both the opening and the cavity when the ball is received in the surrounding portion.

11. The massage device of claim 10, wherein the surrounding portion is an elastic material which conforms to a shape of the ball, a majority of the surface of the ball being in contact with the surrounding portion.

* * * * *